US011618126B2

(12) United States Patent
Chen et al.

(10) Patent No.: US 11,618,126 B2
(45) Date of Patent: Apr. 4, 2023

(54) POLISHING PAD CONDITIONING APPARATUS

(71) Applicant: TAIWAN SEMICONDUCTOR MANUFACTURING COMPANY LIMITED, Hsin-Chu (TW)

(72) Inventors: Cheng-Ping Chen, Taichung (TW); Shih-Chung Chen, Hsinchu (TW); Sheng-Tai Peng, Miaoli County (TW); Hung-Lin Chen, Pingtung (TW)

(73) Assignee: TAIWAN SEMICONDUCTOR MANUFACTURING COMPANY LIMITED, Hsinchu (TW)

( * ) Notice: Subject to any disclaimer, the term of this patent is extended or adjusted under 35 U.S.C. 154(b) by 118 days.

(21) Appl. No.: 16/921,092

(22) Filed: Jul. 6, 2020

(65) Prior Publication Data

US 2021/0060727 A1 Mar. 4, 2021

Related U.S. Application Data

(60) Provisional application No. 62/894,656, filed on Aug. 30, 2019.

(51) Int. Cl.

| | |
|---|---|
| ***B24B 53/017*** | (2012.01) |
| ***B24B 37/20*** | (2012.01) |
| *B24D 13/10* | (2006.01) |
| *B24D 13/14* | (2006.01) |

(52) U.S. Cl.

CPC ..... *B24B 53/017* (2013.01); *B24B 37/20* (2013.01); *B24D 13/10* (2013.01); *B24D 13/145* (2013.01)

(58) Field of Classification Search

CPC .... B24D 13/14; B24D 13/142; B24D 13/145; B24D 7/06; B24D 7/14; B24D 7/18; B24D 11/003; B24D 11/02; B24D 11/04; B24D 3/28; B24D 13/10; B24D 18/0009; B24B 53/017; B24B 53/02; B24B 37/20; B24B 53/007; B24B 53/12; B24B 29/005; A46B 13/008; A46B 3/005; A46B 7/04; A46B 13/003; A46B 2200/3093; A46D 1/023; A46D 1/00; B29C 45/0013; B29C 2045/0015; B29L 2031/7654

USPC ..... 451/442, 56, 443, 444, 508, 527, 529, 451/532

See application file for complete search history.

(56) References Cited

U.S. PATENT DOCUMENTS

| | | | | |
|---|---|---|---|---|
| 5,525,100 | A * | 6/1996 | Kelly | B24D 13/145 451/527 |
| 5,679,067 | A * | 10/1997 | Johnson | B24D 3/28 451/527 |
| 6,126,533 | A * | 10/2000 | Johnson | A46D 1/00 451/550 |
| 6,224,470 | B1 * | 5/2001 | Hoey | B24B 53/017 451/285 |
| 6,261,156 | B1 * | 7/2001 | Johnson | B29C 45/0013 451/63 |
| 6,352,471 | B1 * | 3/2002 | Bange | A46B 3/005 451/527 |
| 7,367,872 | B2 * | 5/2008 | Donohue | B24B 53/017 451/443 |

(Continued)

*Primary Examiner* — Joel D Crandall
*Assistant Examiner* — Jason Khalil Hawkins
(74) *Attorney, Agent, or Firm* — Cooper Legal Group, LLC

(57) ABSTRACT

A polishing pad conditioning apparatus includes a base, a fiber, and a polymer protruding from a surface of the base and encompassing the fiber.

20 Claims, 7 Drawing Sheets

(56) References Cited

U.S. PATENT DOCUMENTS

| | | | | |
|---|---|---|---|---|
| 2002/0127962 | A1* | 9/2002 | Cho | B24B 53/12 451/443 |
| 2006/0079160 | A1* | 4/2006 | Balagani | B24B 53/12 451/285 |
| 2007/0077870 | A1* | 4/2007 | Fujita | B24D 13/10 451/56 |
| 2009/0075567 | A1* | 3/2009 | Wang | B24B 53/017 451/56 |
| 2012/0233791 | A1* | 9/2012 | Uchida | A46D 1/0207 15/22.2 |
| 2016/0074995 | A1* | 3/2016 | Chou | B24B 53/017 451/443 |
| 2019/0193245 | A1* | 6/2019 | Tregub | B24B 37/34 |

* cited by examiner

POLISHING PAD CONDITIONING APPARATUS

RELATED APPLICATION

This application claims priority to U.S. Provisional Patent Application 62/894,656, titled "SEMICONDUCTOR CHEMICAL MECHANICAL POLISHING (CMP) WITH COMPOSITE MATERIAL" and filed on Aug. 30, 2019, which is incorporated herein by reference.

BACKGROUND

Chemical mechanical polishing (CMP) is a widely used process by which both chemical and physical forces are used to globally planarize a semiconductor workpiece, such as a wafer. Generally, the planarization prepares the workpiece for the formation of a subsequent layer. A typical CMP tool comprises a rotating platen covered by a polishing pad. A slurry distribution system is configured to provide a polishing mixture, having chemical and abrasive components, to the polishing pad. A workpiece is then brought into contact with the rotating polishing pad to planarize the workpiece.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
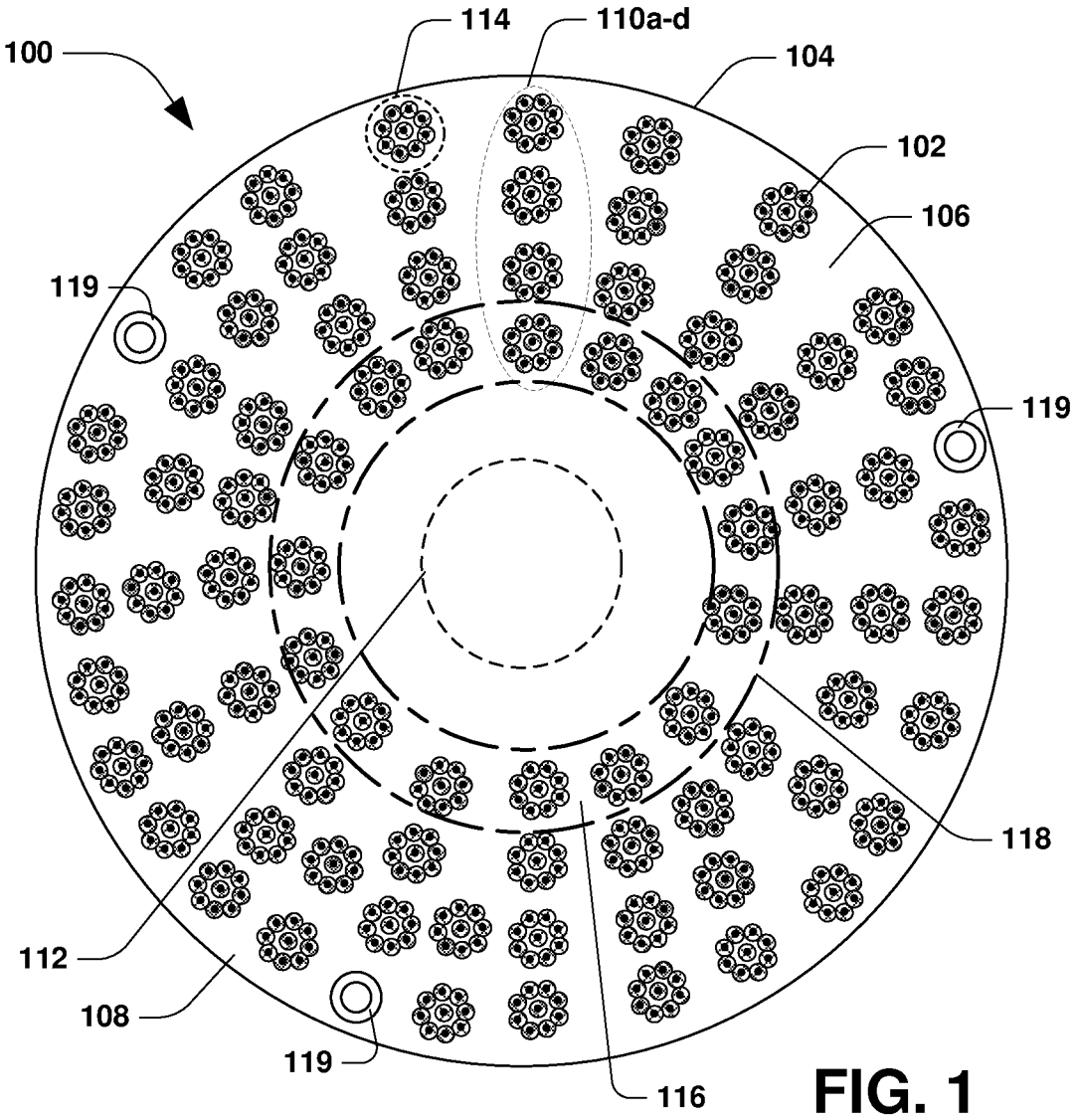
FIG. 1 is a top view of a polishing pad conditioning apparatus, according to some embodiments.

The following disclosure provides several different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact and may also include embodiments in which additional features may be formed between the first and second features, such that the first and second features may not be in direct contact. In addition, the present disclosure may repeat reference numerals or letters in the various examples. This repetition is for the purpose of simplicity and clarity and does not in itself dictate a relationship between the various embodiments or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation illustrated in the figures. The apparatus may be otherwise oriented (rotated 90 degrees or at other orientations) and the spatially relative descriptors used herein may likewise be interpreted accordingly.

One or more polishing pad conditioning apparatuses for conditioning a semiconductor wafer polishing pad are provided herein. According to some embodiments, a polishing pad conditioning apparatus comprises a base structure having protrusions protruding from a surface of the base structure. According to some embodiments, the base structure is an elliptical disk and at least some of the protrusions are composites. According to some embodiments, at least some of the composite protrusions comprise a polymer circumscribing a fiber. According to some embodiments, the fiber protrudes beyond a tip portion of the polymer. According to some embodiments, the protrusions are arranged in clusters of protrusions on the base structure. According to some embodiments, a plurality of clusters of protrusions are arranged in the form of an ellipse on the base structure. According to some embodiments, several pluralities of clusters are arranged in the form of several ellipses on the base structure. According to some embodiments, the several ellipses are concentric circles. According to some embodiments, some protrusions within a cluster of protrusions are a first height, while other protrusions within the cluster of protrusions are a second height. According to some embodiments, the second height is different than the first height.

FIG. 1 is a top view of a polishing pad conditioning apparatus 100, according to some embodiments. According to some embodiments, the polishing pad conditioning apparatus 100 includes protrusions 102 attached to a base 104. According to some embodiments, the base 104 comprises a substrate, disk, platform, support structure, or other suitable device or foundation. According to some embodiments, the base 104 comprises at least one of metal, polymer, crystalline material, non-crystalline material, substance, mixture of substances, or other suitable materials. According to some embodiments, the base 104 is a substrate comprising a semiconductor material. In some embodiments, the base 104 comprises at least one of silicon, germanium, carbide, gallium, arsenide, germanium, arsenic, indium, oxide, sapphire, or other suitable materials.

According to some embodiments, the shape of the base 104 is at least one of conical, disk-like, geometric, elliptical, polygonal, symmetrical, asymmetrical, irregular, or other suitable shape. According to some embodiments, the base 104 is at least one of circular, oval, rounded, or other shape having one or more foci. According to some embodiments, the base 104 includes a peripheral portion 108, such as at or near a perimeter of the base, and a center portion 112. According to some embodiments, the protrusions 102 are located between the peripheral portion 108 and the center portion 112. According to some embodiments, the protrusions 102 are located at least one of at the peripheral portion 108, at the center portion 112, or between the peripheral portion 108 and the center portion 112.

According to some embodiments, the protrusions 102 protrude away from the surface 106 of the base 104. According to some embodiments, some protrusions 102 protrude away from and perpendicular to the surface 106 of the base 104. According to some embodiments, some protrusions 102 protrude away from the base 104 at an angle that is not perpendicular to the surface 106 of the base 104. According to some embodiments, some protrusions 102 protrude away from and perpendicular to the surface 106 of the base 104, and some other protrusions 102 protrude away from the base 104 at an angle that is not perpendicular to the surface 106 of the base 104.

According to some embodiments, two or more protrusions are arranged as a cluster of protrusions 114 on the base 104. According to some embodiments, a cluster of protrusions 114 refers to multiple protrusions positioned closely together.

According to some embodiments, the polishing pad conditioning apparatus 100 includes one or more clusters of protrusions. According to some embodiments, a plurality of clusters of protrusions 116 are arranged on the base 104 in the form of an ellipse 118. According to some embodiments, an ellipse is at least one of circular, oval, rounded, or other shape having one or more foci. According to some embodiments, the ellipse 118 defines a zone of the base 104. According to some embodiments, multiple pluralities of clusters of protrusions are arranged as multiple concentric ellipses on the base 104. According to some embodiments, multiple pluralities of clusters of protrusions are arranged as multiple concentric circles on the base 104. According to some embodiments, a first plurality of clusters of protrusions 116 is a first distance from the perimeter of the base 104, and a second a plurality of clusters of protrusions 116 is a second distance from the perimeter of the base 104. According to some embodiments, the first distance is greater than the second distance.

According to some embodiments, a plurality of clusters of protrusions 116 are arranged as one or more geometric shapes on the base 104. According to some embodiments, a geometric shape comprising a plurality of clusters of protrusions 116 defines a zone of the polishing pad conditioning apparatus 100. According to some embodiments, the polishing pad conditioning apparatus 100 comprises one or more zones. According to some embodiments, one or more clusters of protrusions, such as 110*a*-110*d*, are arranged between the center portion 112 and the peripheral portion 108 of the base 104. According to some embodiments, the polishing pad conditioning apparatus 100 has a first zone that is a first shape and a second zone that is a second shape different than the first shape. According to some embodiments, the polishing pad conditioning apparatus 100 has a first zone that is elliptical and a second zone that is between the center portion 112 of the base 104 and the peripheral portion 108 of the base 104. According to some embodiments, the polishing pad conditioning apparatus 100 has any number of zones. According to some embodiments, the polishing pad conditioning apparatus 100 has any number of protrusions 102. According to some embodiments, the protrusions 102 are arranged relative to one another in any manner, configuration, etc. According to some embodiments, the polishing pad conditioning apparatus 100 has any number of clusters of protrusions 114. According to some embodiments, the clusters of protrusions 114 are arranged relative to one another in any manner, configuration, etc.

According to some embodiments, the base 104 includes one or more mounting mechanisms 119 for attaching the polishing pad conditioning apparatus 100 to a wafer polishing apparatus. According to some embodiments, the one or more mounting mechanisms 119 are at least one of a female fitting, a male fitting, a connector, a clasp, an aperture, a recess, or other suitable item. According to some embodiments, at least some of the one or more mounting mechanisms 119 are an aperture or recess fashioned into or through the base 104. According to some embodiments, at least some of the one or more mounting mechanisms 119 are attached to the base 104, such as a connector, clasp, etc. joined to the base 104 by soldering, fusing, chemical bonding, etc.

Figure 2:
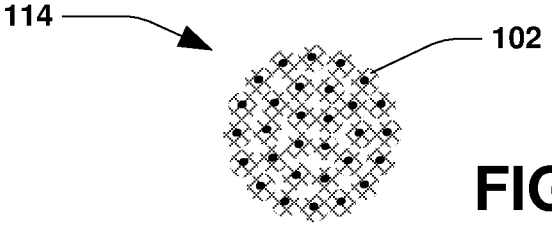
FIG. 2 is a top view of a cluster of protrusions of a polishing pad conditioning apparatus, according to some embodiments.

FIG. 2 is a top view of a cluster of protrusions 114, according to some embodiments. According to some embodiments, the cluster of protrusions 114 comprises a plurality of protrusions 102 arranged as at least one of elliptical, polygonal, geometric, concentric, linear, symmetrical, asymmetrical, or other suitable arrangements. According to some embodiments, the protrusions 102 are positioned on the base in an unarranged configuration.

Figure 3:
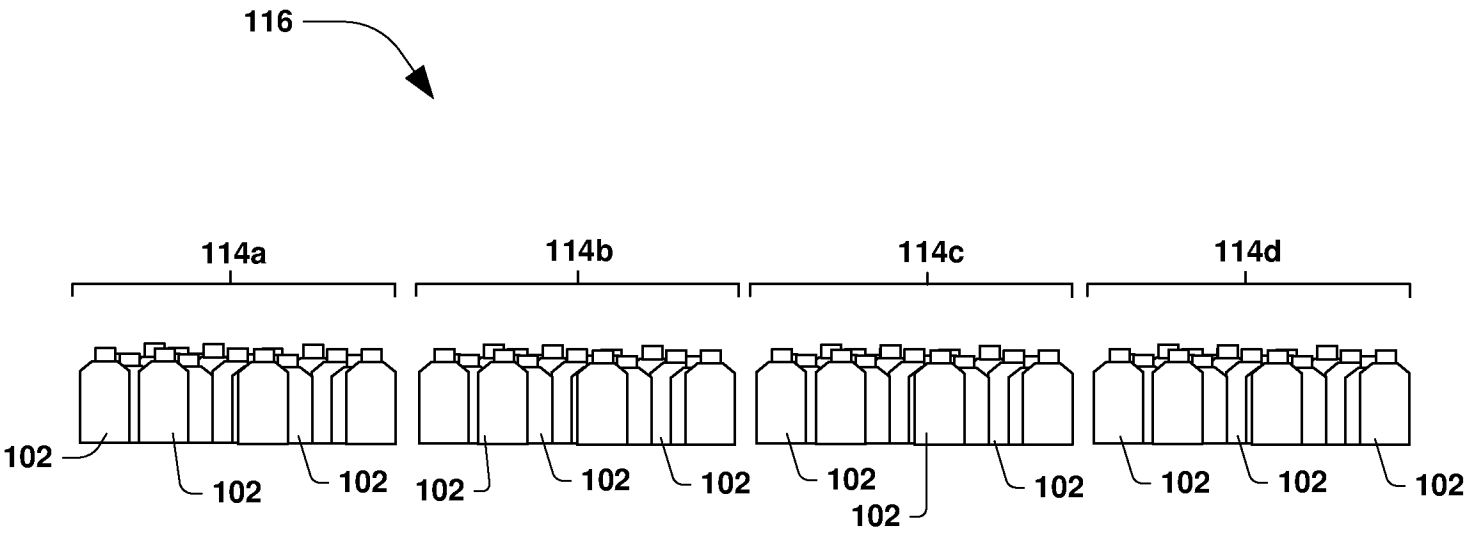
FIG. 3 is an illustration of an array of protrusions of a polishing pad conditioning apparatus, according to some embodiments.

FIG. 3 is an illustration of a plurality of clusters of protrusions 116, namely a first cluster of protrusions 114*a*, a second cluster of protrusions 114*b*, a third cluster of protrusions 114*c*, and a fourth cluster of protrusions 114*d* of a polishing pad conditioning apparatus, according to some embodiments. According to some embodiments, the first cluster of protrusions 114*a* includes a first number of protrusions 102, the second cluster of protrusions 114*b* includes a second number of protrusions 102, the third cluster of protrusions 114*c* includes a third number of protrusions 102, and the fourth cluster of protrusions 114*d* includes a fourth number of protrusions 102. According to some embodiments, at least one of the first number of protrusions, the second number of protrusions, the third number of protrusions, or the fourth number of protrusions is different than the number of protrusions of another cluster of protrusions. According to some embodiments, the protrusions 102 of the first cluster of protrusions 114*a* are arranged in a first arrangement, the protrusions 102 of the second cluster of protrusions 114*b* are arranged in a second arrangement, the protrusions 102 of the third cluster of protrusions 114*c* are arranged in a third arrangement, and the protrusions 102 of the fourth cluster of protrusions 114*d* are arranged in a fourth arrangement. According to some embodiments, at least one of the first arrangement, the second arrangement, the third arrangement, or the fourth arrangement is different than the arrangement of protrusions of another cluster of protrusions. According to some embodiments, the first cluster of protrusions 114*a*, the second cluster of protrusions 114*b*, the third cluster of protrusions 114*c*, and the fourth cluster of protrusions 114*d* are separated from one another by any distance, dimension, etc. According to some embodiments, distances, dimensions, etc. between different clusters of protrusions vary.

Figure 4:
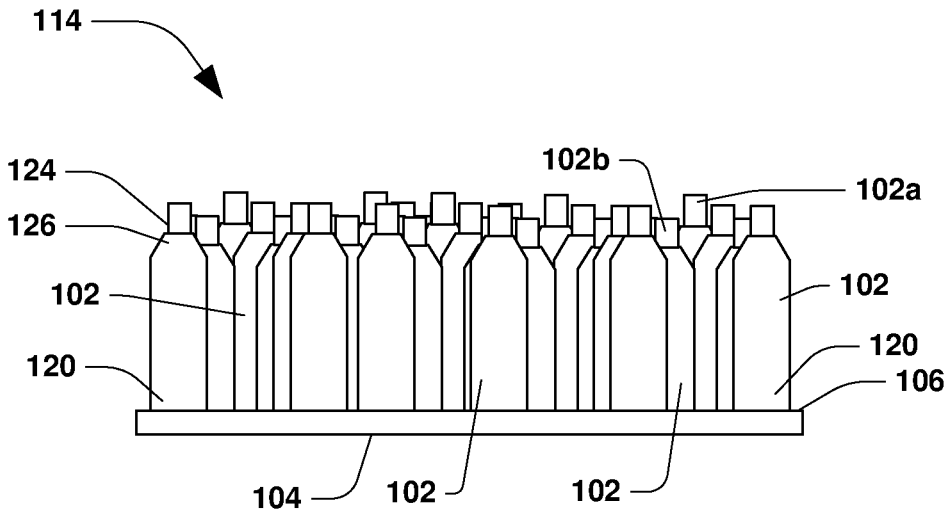
FIG. 4 illustrates a cluster of protrusions of a polishing pad conditioning apparatus, according to some embodiments.

FIG. 4 illustrates a cluster of protrusions 114, according to some embodiments. According to some embodiments, proximate ends 120 to the surface 106 of the base 104 of some protrusions 102 are directly attached to the base 104. According to some embodiments, proximate ends 120 to the surface 106 of the base 104 of some protrusions 102 are indirectly attached to the base 104, such as by an intermediary, a mount, a connector, a support, or other suitable structures (not shown).

According to some embodiments, the proximate ends 120 to the surface 106 of the base 104 of some protrusions 102 are embedded in the base 104. According to some embodiments, the proximate ends 120 to the surface 106 of the base 104 of some protrusions 102 are friction fit into the base 104. According to some embodiments, the proximate ends 120 to the surface 106 of the base 104 of some protrusions 102 are heat bonded to or into the base 104. According to some embodiments, the proximate ends 120 to the surface 106 of the base 104 of some protrusions 102 are chemically bonded to or into the base 104. According to some embodiments, the proximate ends 120 to the surface 106 of the base 104 of some protrusions 102 are mechanically bonded to or into the base 104. According to some embodiments, at least some protrusions 102 include at least one wafer conditioning material 124.

According to some embodiments, at least some protrusions 102 of the cluster of protrusions 114 are bound together and attached to the base 104 as a group. According to some embodiments, at least some protrusions 102 of the cluster of protrusions 114 are individually attached to the base 104.

According to some embodiments, some protrusions 102 are of uniform length. According to some embodiments, some protrusions 102 are of non-uniform length, such that the length of some protrusions 102 of the cluster of protrusions 114 is different than the length of some other protrusions 102 of the cluster of protrusions 114. According to some embodiments, some protrusions 102 of the cluster of protrusions 114 have a first length, some other protrusions 102 of the cluster of protrusions 114 have a second length, and yet other protrusions 102 of the cluster of protrusions 114 have a third length. According to some embodiments, the first length is different than the second length and the third length, and the second length is different than the third length. According to some embodiments, the cluster of protrusions 114 comprises protrusions 102 of more than three different lengths.

According to some embodiments, in use some protrusions 102 of the cluster of protrusions 114 have a first polishing performance, some other protrusions 102 of the cluster of protrusions 114 have a second polishing performance, and yet other protrusions 102 of the cluster of protrusions 114 have a third polishing performance. According to some embodiments, the first polishing performance is greater than the second polishing performance, and the second polishing performance is greater than the third polishing performance. According to some embodiments, initially the first polishing performance is greater than the second and third polishing performances, and subsequently the second polishing performance is greater than the first and third polishing performances. According to some embodiments, the third polishing performance is greater than the first and second polishing performances.

According to some embodiments, some protrusions 102 of the cluster of protrusions 114 wear down over time due to frictional contact with one or more polishing pads during conditioning. According to some embodiments, when the cluster of protrusions 114 is initially put to use for conditioning polishing pads, the longer protrusions 102, such as at least one protrusion 102*a*, contact the surfaces of the polishing pads to a greater extent than the shorter protrusions, such as at least one other protrusion 102*b*. According to some embodiments, the protrusions that contact the surface of the polishing pads to a greater extent have a greater polishing effect or performance. As the cluster of protrusions 114 polishes pads over time, the longer protrusions will, on average, wear down sooner than the shorter protrusions. According to some embodiments, when the wafer conditioning material 124 of a longer protrusion wears down to at or below a tip portion 126, the protrusion becomes less effective at polishing. However, according to some embodiments, the full or partial length of the conditioning material of shorter protrusions sustains an effective polishing performance of the cluster of protrusions 114. Thus, according to some embodiments, initially the longer protrusions contact the polishing pads more so than the shorter protrusions, and the longer protrusions have a more effective polishing performance than do the shorter protrusions. Over time of use, the longer protrusions wear down and the relatively shorter protrusions have a greater polishing effect than do the worn down longer protrusions. According to some embodiments, the level of the polishing effect or performance of a cluster of protrusions having protrusions of different lengths is maintained to a higher degree as compared to a cluster of protrusions having all protrusions of the same length.

Figure 5:
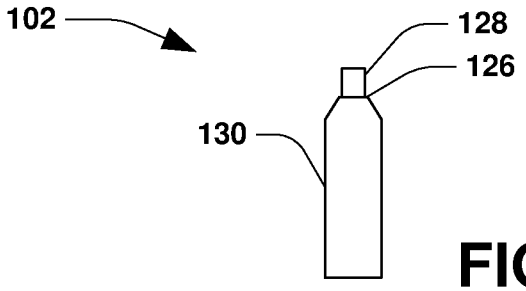
FIG. 5 illustrates a composite protrusion of a polishing pad conditioning apparatus, according to some embodiments.

Referring to FIG. 5, according to some embodiments a protrusion 102 comprises more than one material and is, at times, referred to as a composite protrusion. According to some embodiments, the composite protrusion comprises a polishing component 128 and a reinforcement component 130. According to some embodiments, the polishing component 128 protrudes beyond a tip portion 126 of the reinforcement component 130. According to some embodiments, below the tip portion 126 the reinforcement component 130 completely encompasses or surrounds the polishing component 128. According to some embodiments, below the tip portion 126 the reinforcement component 130 partially encompasses or surrounds the polishing component 128. According to some embodiments, the reinforcement component 130 encircles the polishing component 128. According to some embodiments, the reinforcement component 130 partially encircles the polishing component 128. According to some embodiments, the reinforcement component 130 buttresses the entire periphery of the polishing component 128. According to some embodiments, the reinforcement component 130 buttresses a portion of the periphery of the polishing component 128. According to some embodiments, the reinforcement component 130 buttresses one side of the polishing component 128. According to some embodiments, the reinforcement component 130 buttresses more than one side of the polishing component 128. According to some embodiments, the reinforcement component 130 is a sheath. According to some embodiments, the reinforcement component 130 has apertures, gaps, or slits. According to some embodiments, the reinforcement component 130 has a closed body. According to some embodiments, the reinforcement component 130 comprises segments. According to some embodiments, the reinforcement component 130 comprises a plurality of threads.

Figure 6:
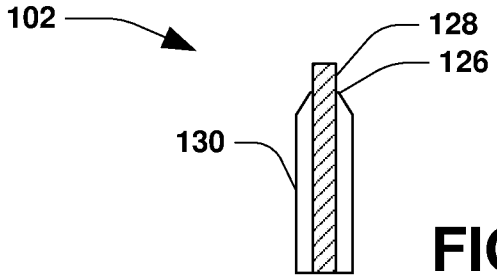
FIG. 6 is a cross-sectional view of a composite protrusion of a polishing pad conditioning apparatus, according to some embodiments.

FIG. 6 is a cross-sectional view of a protrusion 102 comprising more than one material, according to some embodiments. According to some embodiments, the polishing component 128 extends lengthwise along an interior portion of the reinforcement component 130. According to some embodiments, the polishing component 128 extends lengthwise along a center portion of the reinforcement component 130. According to some embodiments, the polishing component 128 extends partially along a center portion of the reinforcement component 130. According to some embodiments, the polishing component 128 extends along a peripheral portion of the reinforcement component 130. According to some embodiments, the polishing component 128 has a length that is greater than the length of the reinforcement component 130. According to some embodiments, the polishing component 128 has a length that is less than the length of the reinforcement component 130 and protrudes beyond the tip portion 126.

According to some embodiments, the polishing component 128 is a single component. According to some embodiments, the polishing component 128 comprises more than one component. According to some embodiments, the polishing component 128 comprises two or more coupled components. According to some embodiments, the polishing component 128 comprises two or more distinct components. According to some embodiments, the polishing component 128 comprises a composite of materials. According to some embodiments, the polishing component 128 comprises one or more conditioning fibers. According to some embodiments, the polishing component 128 comprises at least one carbon fiber.

According to some embodiments, the polishing component 128 is inflexible. According to some embodiments, the polishing component 128 is predominantly inflexible. According to some embodiments, the polishing component 128 is rigid. According to some embodiments, the polishing component 128 is predominantly rigid. According to some embodiments, the polishing component 128 is brittle.

According to some embodiments, the tensile strength of the polishing component 128 is greater than 300 kilopounds per square inch (ksi) and less than 700 ksi. According to some embodiments, the tensile strength of the polishing component 128 is greater than 450 ksi and less than 550 ksi.

According to some embodiments, the density of the polishing component 128 is greater than 1.0 g/cm$^3$ and less than 3.0 g/cm$^3$. According to some embodiments, the density of the polishing component 128 is greater than 1.5 g/cm$^3$ and less than 1.7 g/cm$^3$.

According to some embodiments, the modulus of elasticity of the polishing component 128 is greater than 15 mega-pounds per square inch (Msi) and less than 30 Msi. According to some embodiments, the modulus of elasticity of the polishing component 128 is greater than 18 Msi and less than 22 Msi.

According to some embodiments, the polishing component 128 is chemical resistant. According to some embodiments, the polishing component 128 remains stable at temperatures above 300° Fahrenheit. According to some embodiments, the coefficient of thermal expansion of the polishing component 128 is negative.

According to some embodiments, the polishing component 128 comprises carbon. According to some embodiments, the polishing component 128 comprises carbon crystals. According to some embodiments, the polishing component 128 comprises carbon fiber. According to some embodiments, the carbon content of the polishing component 128 is greater than 90% by weight.

According to some embodiments, the polishing component 128 comprises glass. According to some embodiments, the polishing component 128 comprises glass fiber. According to some embodiments, the polishing component 128 comprises plastic. According to some embodiments, the polishing component 128 comprises plastic fiber. According to some embodiments, the polishing component 128 comprises a composite of at least one of carbon, glass, or plastic. According to some embodiments, the polishing component 128 comprises a plurality of at least one of carbon fibers, glass fibers, or plastic fibers.

According to some embodiments, the polishing component 128 is turbostratic. According to some embodiments, the polishing component 128 is graphitic. According to some embodiments, the polishing component 128 is a hybrid structure with both graphitic and turbostratic components.

According to some embodiments, the diameter of the polishing component 128 is less than 1 micrometer (mm). According to some embodiments, the diameter of the polishing component 128 is greater than 1 mm and less than 120 mm. According to some embodiments, the diameter of the polishing component 128 is less than the diameter of the reinforcement component 130. According to some embodiments, the polishing component comprises multiple components having a diameter that is less than the diameter of the reinforcement component 130.

According to some embodiments, the reinforcement component 130 is a single component. According to some embodiments, the reinforcement component 130 is comprised of more than one component. According to some embodiments, the reinforcement component 130 is comprised of two or more intertwined components. According to some embodiments, the reinforcement component 130 is comprised of two or more distinct components. According to some embodiments, the reinforcement component 130 is composite matter.

According to some embodiments, the reinforcement component 130 has properties that are similar to the properties of the polishing component 128. According to some embodiments, the reinforcement component 130 has properties that are different from the properties of the polishing component 128. According to some embodiments, the reinforcement component 130 is inflexible. According to some embodiments, the reinforcement component 130 is marginally flexible. According to some embodiments, the reinforcement component 130 is rigid. According to some embodiments, the reinforcement component 130 is predominantly rigid. According to some embodiments, the reinforcement component 130 is more rigid than the polishing component 128. According to some embodiments, the reinforcement component 130 is less brittle than the polishing component 128. According to some embodiments, the reinforcement component 130 is more resistant to fracturing than the polishing component 128.

According to some embodiments, the reinforcement component 130 is resistant to chemicals. According to some embodiments, the reinforcement component 130 uptakes and absorbs little to no moisture. According to some embodiments, the reinforcement component 130 is resistant to heat and maintains mechanical strength and dimension across a broad temperature range. According to some embodiments, the reinforcement component 130 is rigid and resistant to creep, and retains stiffness and strength in a broad range of environmental conditions.

According to some embodiments, the tensile strength of the reinforcement component 130 is greater than 10 ksi and less than 20 ksi. According to some embodiments, the tensile strength of the reinforcement component 130 is greater than 12 ksi and less than 16 ksi.

According to some embodiments, the density of the reinforcement component 130 is greater than 0.5 g/cm$^3$, and less than 3.0 g/cm$^3$. According to some embodiments, the density of the reinforcement component 130 is greater than 1.2 g/cm$^3$ and less than 1.4 g/cm$^3$.

According to some embodiments, the modulus of elasticity of the reinforcement component 130 is greater than 0.25 Msi and less than 1 Msi. According to some embodiments, the modulus of elasticity of the reinforcement component 130 is greater than 0.5 Msi and less than 0.6 Msi.

According to some embodiments, the reinforcement component 130 is chemical resistant. According to some embodiments, the reinforcement component 130 remains stable at temperatures above 300° Fahrenheit. According to some embodiments, the coefficient of thermal expansion of the reinforcement component 130 is positive.

According to some embodiments, the reinforcement component 130 comprises a polymer. According to some embodiments, the reinforcement component 130 comprises a semi-crystalline thermoplastic. According to some embodiments, the reinforcement component 130 comprises polyetheretherketone (PEEK).

According to some embodiments, the protrusion 102 comprises a polishing component 128 comprising carbon, carbon crystals, or carbon fibers, and a reinforcement component 130 comprising a polymer, semi-crystalline thermoplastic, or PEEK.

Figure 7:
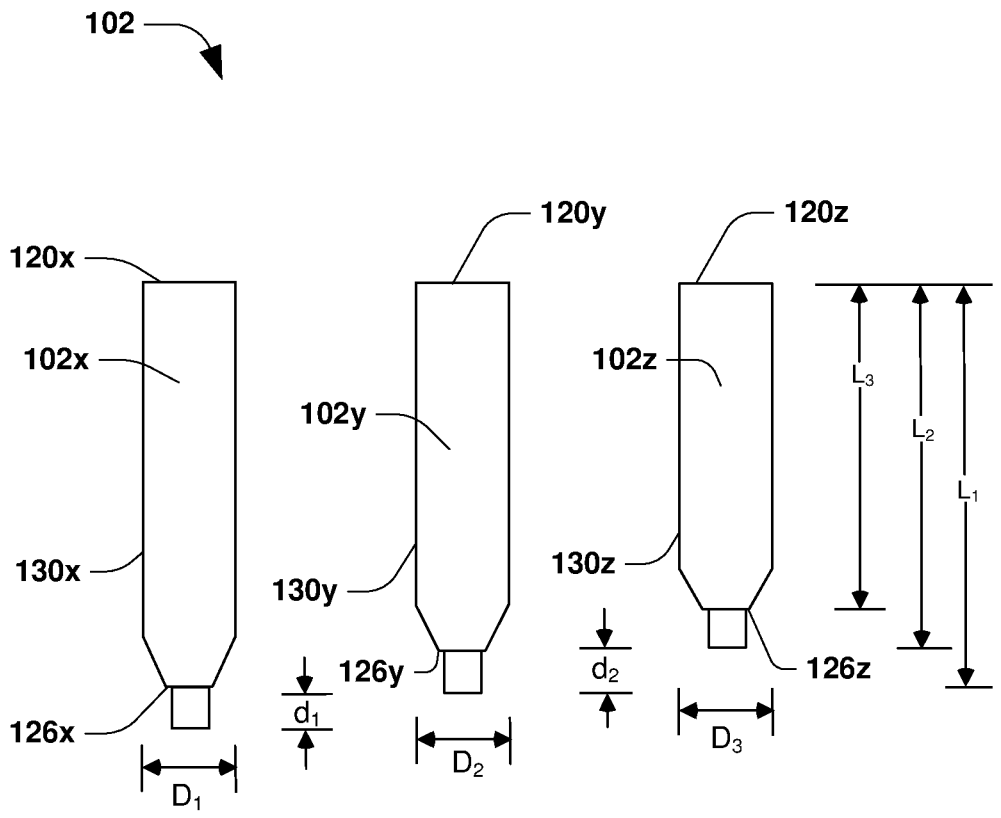
FIG. 7 illustrates several composite protrusions of different lengths, according to some embodiments.

FIG. 7 illustrates several protrusions 102 of different lengths, namely a first protrusion 102*x*, a second protrusion 102*y*, and a third protrusion 102*z*, according to some embodiments. According to some embodiments, reinforcement component 130*x* of the first protrusion 102*x* has a length $L_1$, reinforcement component 130*y* of the second protrusion 102*y* has a length $L_2$, and reinforcement component 130*z* of the third protrusion 102*z* has a length $L_3$. According to some embodiments, the length $L_1$ of reinforcement component 130*x* is the distance from the reinforcement tip 126*x* to the reinforcement end 120*x*, the length $L_2$ of reinforcement component 130*y* is the distance from the reinforcement tip 126*y* to the reinforcement end 120*y*, and the length $L_3$ of reinforcement component 130*z* is the distance from the reinforcement tip 126*z* to the reinforcement end 120*z*. According to some embodiments, the initial length of a reinforcement component 130 is the length of the reinforcement prior to first use of the reinforcement component for conditioning a polishing pad. According to some embodiments, the initial lengths $L_1$, $L_2$, and $L_3$ of the reinforcement components 130*x*, 130*y*, and 130*z* are greater than 1 millimeter (mm) and less than 20 mm. According to some embodiments, a removal rate of debris, contaminants, non-uniformities, etc. from a polishing pad is maintained substantially constant throughout the process lifetime of the reinforcement components 130*x*, 130*y*, and 130*z* if the initial lengths $L_1$, $L_2$, and $L_3$ of the reinforcement components 130*x*, 130*y*, and 130*z* are within a range of 1 mm to 20 mm. According to some embodiments, the first length $L_1$ is different than the second length $L_2$, and the third length $L_3$ is different than the first length $L_1$ and the second length $L_2$. According to some embodiments, if the initial lengths of the reinforcement components 130*x*, 130*y*, and 130*z* are greater than 20 mm, then at least some of the reinforcement components 130*x*, 130*y*, and 130*z* bend, buckle, etc. which inhibits removal of debris, contaminants, non-uniformities, etc. According to some embodiments, if the initial lengths of the reinforcement components 130*x*, 130*y*, and 130*z* are less than 1 mm, then a service life of the polishing pad conditioning apparatus 100 is reduced below a desired threshold.

According to some embodiments, the diameters $D_1$, $D_2$, and $D_3$ of the reinforcement components 130*x*, 130*y*, and 130*z* are greater than 1 mm and less than 120 mm. According to some embodiments, the diameters $D_1$, $D_2$, and $D_3$ of the reinforcement components 130*x*, 130*y*, and 130*z* are inversely proportional to the number of protrusions 102 that together are attached to the base 104. According to some embodiments, the greater the diameters $D_1$, $D_2$, and $D_3$, the fewer the number of protrusions 102 that are together attached to the base 104. According to some embodiments, the lesser the diameters $D_1$, $D_2$, and $D_3$, the greater the number of protrusions 102 that are together attached to the base 104. According to some embodiments, reinforcement components 130*x*, 130*y*, and 130*z* having diameters $D_1$, $D_2$, and $D_3$ within a range of 1 mm to 120 mm provides for a quantity of protrusions 102 attached to the base 104 to amply conditioning of a polishing pad by the polishing pad conditioning apparatus 100.

According to some embodiments, the diameters $D_1$, $D_2$, and $D_3$ of the reinforcement components 130*x*, 130*y*, and 130*z* are the same. According to some embodiments, the diameters $D_1$, $D_2$, and $D_3$ of the reinforcement components 130*x*, 130*y*, and 130*z* are different. According to some embodiments, some reinforcement components have a first diameter, and some other reinforcement components have a second diameter. According to some embodiments, the first diameter is different than the second diameter. According to some embodiments, some reinforcement components have a first diameter, some other reinforcement components have a second diameter, and yet some other reinforcement components have a third diameter. According to some embodiments, the first diameter is different than the second diameter, and the third diameter is different than the first and second diameters.

According to some embodiments, the differences ($d_1$, $d_2$, and $d_1+d_2$) in the initial lengths among protrusions 102*x*, 102*y*, and 102*z* are greater than 0.1 mm and less than 20 mm. According to some embodiments, differences in initial lengths that are greater than 0.1 mm and less than 20 mm provide that a next-lower length protrusion 102*y* will contact a polishing pad prior to a longer protrusion 102*x* wearing down and becoming ineffective at conditioning a polishing pad, so that at least some protrusions remain in contact with polishing pad. According to some embodiments, some protrusions among several protrusions are of a first length and some other protrusions among the several protrusions are of a second length. According to some embodiments the first length is different than the second length. According to some embodiments, some protrusions among several protrusions are of a first length, some other protrusions among the several protrusions are of a second length, and yet some other protrusions among the several protrusions are of a third length. According to some embodiments, the first length is different than the second length, and the third length is different than the first length and the second length.

According to some embodiments the difference in length d1 among some protrusions of several protrusions is different than the difference in length d2 among some other protrusions of the several protrusions. According to some embodiments, $d_1 \neq d_2$.

Figure 8:
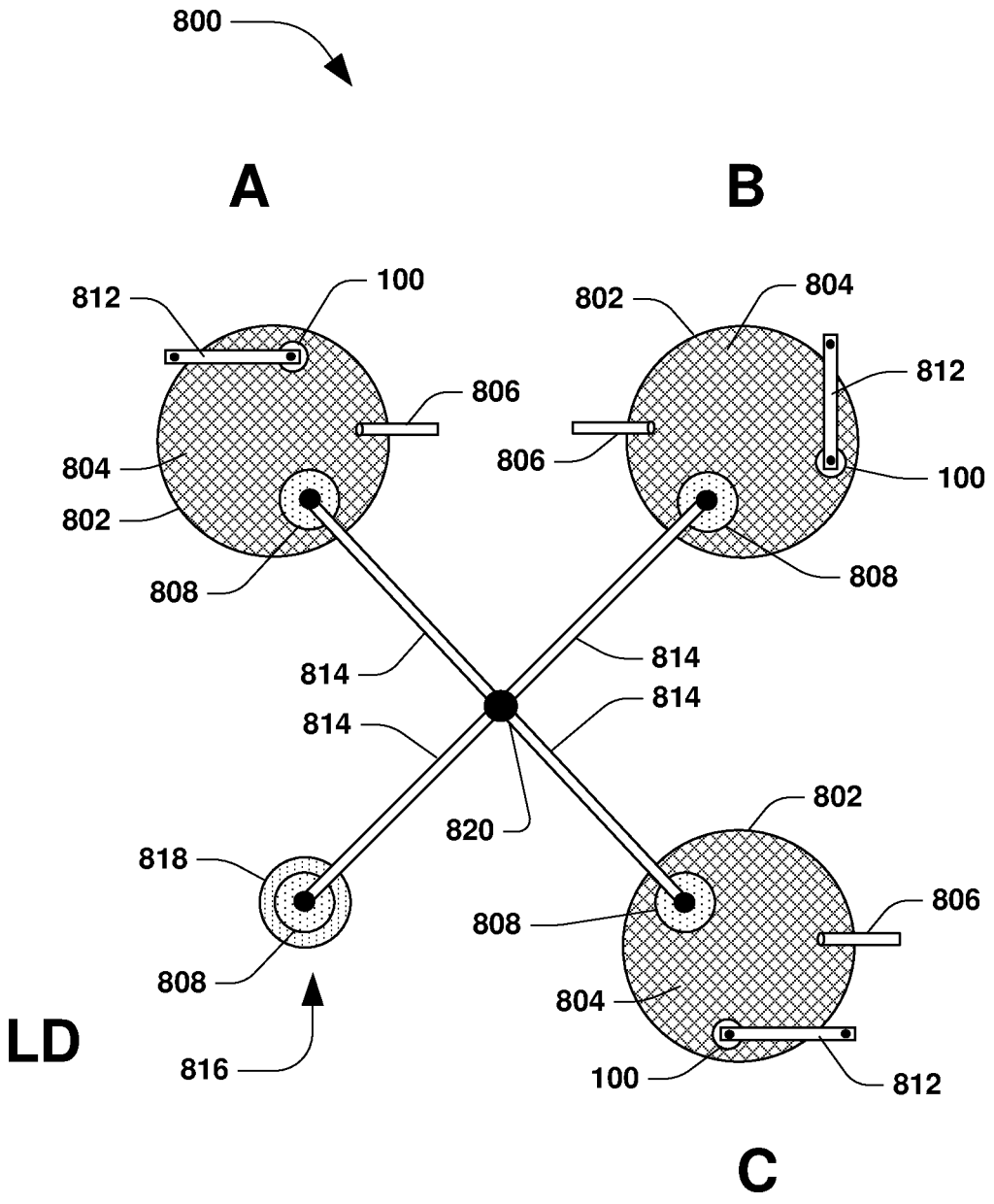
FIG. 8 illustrates a wafer polishing apparatus, according to some embodiments.

FIG. 8 illustrates a wafer polishing apparatus 800, according to some embodiments. According to some embodiments, the wafer polishing apparatus 800 includes three plates 802, three wafer polishing pads 804, three slurry injection units 806, four polishing head units 808, and three polishing pad conditioning apparatuses 100 coupled to three support arms 812. According to some embodiments, the three plates 802 are configured to receive the three wafer polishing pads 804. According to some embodiments, the three wafer polishing pads 804 are configured to be secured over the top surface of the three plates 802. According to some embodiments, the wafer polishing apparatus 800 includes four support structures 814 coupled to the four polishing head units 808. According to some embodiments, the four support structures 814 are at least one of rods, beams, bars, or other suitable structures and intersect a point of rotation 820. According to some embodiments, the three polishing pad conditioning apparatuses 100 are coupled to the three support arms 812 by the one or more mounting mechanisms 119 (FIG. 1).

According to some embodiments, the wafer polishing apparatus 800 includes a loading plate unit 816 configured to secure wafers for polishing. According to some embodiments, the loading plate unit 816 includes a holding unit 818 configured to hold a stack of wafers. According to some embodiments, the undersides of the four polishing head units 808 are configured to secure thereto wafers from the holding unit 818. According to some embodiments, the undersides of the four polishing head units 808 include chucks (not shown) configured to secure a top wafer from the holding unit 818. According to some embodiments, the wafer polishing apparatus 800 is configured to rotate the four support structures 814 by 90-degree increments about the point of rotation 820 in a clockwise or counterclockwise direction.

According to some embodiments, the wafer polishing apparatus 800 is configured to receive a wafer or stack of wafers at the holding unit 818. According to some embodiments, the holding unit 818 and the four polishing head units 808 are configured to transfer a wafer from the holding unit 818 to the undersides of the four polishing head units 808 located at loading station LD. According to some embodiments, the wafer polishing apparatus 800 is configured to rotate the four support structures 814 in a clockwise or counterclockwise direction to transport the wafers from station LD, to stations A, B, and C, and back to station LD. According to some embodiments, a loaded wafer is polished at stations A, B, and C. According to some embodiments, a loaded wafer is polished at one of stations A, B, or C. According to some embodiments, a loaded wafer is polished at one or more of stations A, B, or C.

According to some embodiments, the three plates 802 are configured to rotate about an axis, thereby rotating the three wafer polishing pads 804 that are secured to the three plates 802. According to some embodiments, the three slurry injection units 806 are configured to supply slurry to the three wafer polishing pads 804. According to some embodiments, the four polishing head units 808 are configured to press wafers against the three wafer polishing pads 804. According to some embodiments, the four polishing head units 808 are configured to rotate the wafers against the three wafer polishing pads 804. According to some embodiments, the wafer polishing apparatus 800 is configured to pivot the three support arms 812 and rotate the three polishing pad conditioning apparatuses 100 to condition the three wafer polishing pads 804.

Figure 9:
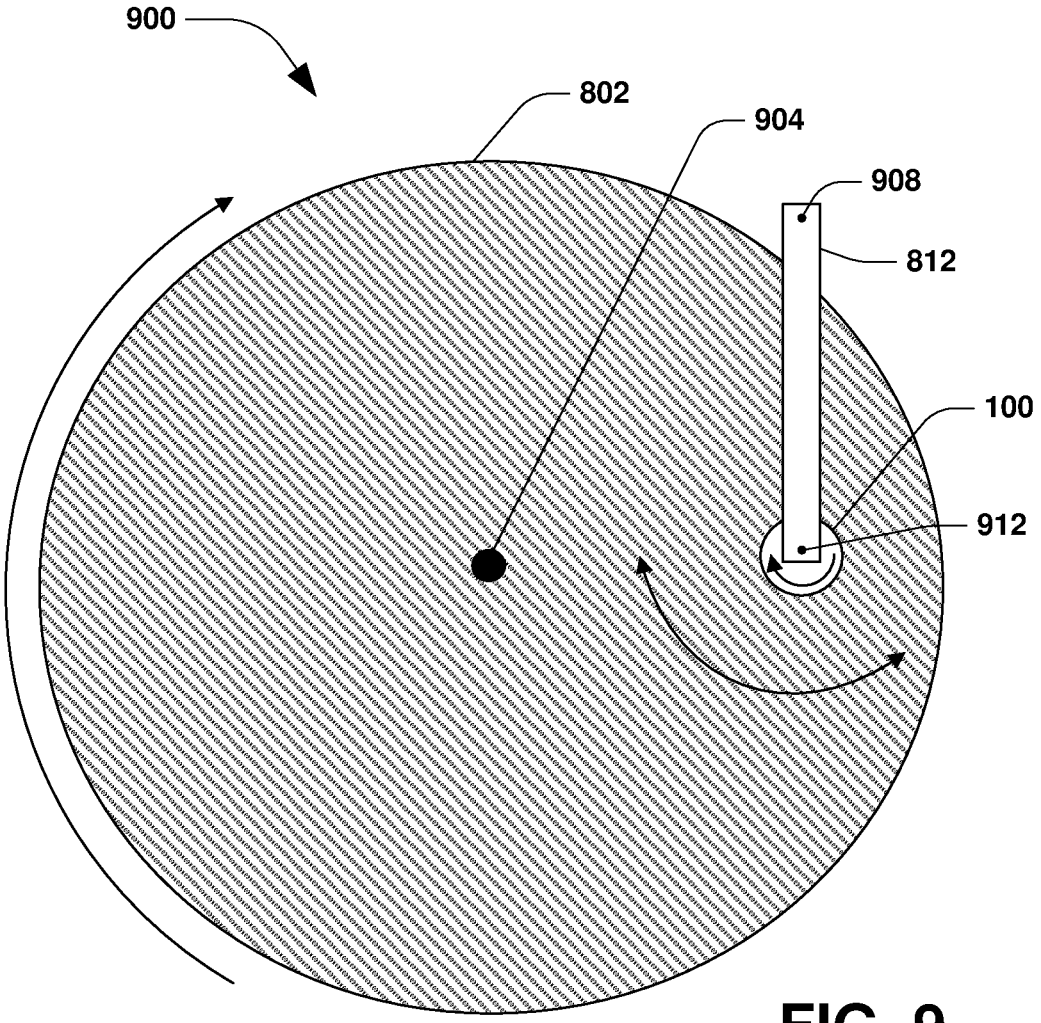
FIG. 9 illustrates movements of a conditioning apparatus, according to some embodiments.

FIG. 9 illustrates movements of a conditioning apparatus 900, according to some embodiments. According to some embodiments, the conditioning apparatus 900 comprises a plate 802, a support arm 812, and a polishing pad conditioning apparatus 100. According to some embodiments, the conditioning apparatus 900 is configured to rotate the plate 802 about center point 904, pivot the support arm 812 about pivot point 908, and rotate the polishing pad conditioning apparatus 100 about center point 912. According to some embodiments, the plate 802 is configured to receive a polishing pad (not shown).

According to some embodiments, a mechanical, electrical, magnetic, or other suitable based power and transmission system is coupled to the plate 802 and configured to rotate the plate 802 in at least one of a clockwise or a counterclockwise direction about center point 904. According to some embodiments, the proximate end to the pivot point 908 of the support arm 812 is coupled to a mechanical, electrical, magnetic, or other suitable based power and transmission system that is configured to pivot the support arm 812 about pivot point 908 in alternating directions. According to some embodiments, the conditioning apparatus 900 is configured to rotate the polishing pad conditioning apparatus 100 in at least one of a clockwise or a counterclockwise direction about center point 912. According to some embodiments, the conditioning apparatus 900 is configured to simultaneously rotate the plate 802, pivot the support arm 812, and rotate the polishing pad conditioning apparatus 100. According to some embodiments, a polishing pad fitted or attached to the plate 802 is conditioned by at least one of the rotating plate 802, the pivoting support arm 812, or the rotating polishing pad conditioning apparatus 100.

Figure 10:
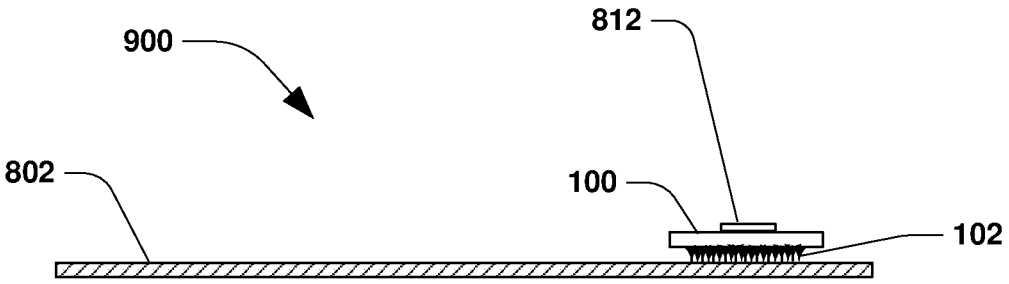
FIG. 10 is a side view of a conditioning apparatus, according to some embodiments.

FIG. 10 is a side view of a conditioning apparatus 900, according to some embodiments. According to some embodiments, the conditioning apparatus 900 comprises a plate 802, a support arm 812, and a polishing pad conditioning apparatus 100 having protrusions 102. According to some embodiments, some of the protrusions 102 include a polishing component and a reinforcement component. According to some embodiments, some of the protrusions 102 include a polymer, as a reinforcement component, encompassing a carbon fiber, as a polishing component.

According to some embodiments, an apparatus for conditioning a semiconductor wafer polishing pad includes a base, a fiber, and a polymer protruding from a surface of the base and encompassing the fiber.

According to some embodiments, an apparatus for conditioning a semiconductor wafer polishing pad includes a base and a first protrusion protruding from a surface of the base. According to some embodiments, a first portion of the first protrusion comprises a polymer and a second portion of the first protrusion comprises carbon.

According to some embodiments, an apparatus for conditioning a semiconductor wafer polishing pad includes a base, a first cluster of protrusions protruding from a surface of the base at a first location on the base, and a second cluster of protrusions protruding from the surface of the base at a second location on the base, different than the first location on the base.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

Although the subject matter has been described in language specific to structural features or methodological acts, it is to be understood that the subject matter of the appended claims is not necessarily limited to the specific features or acts described above. Rather, the specific features and acts described above are disclosed as example forms of implementing at least some of the claims.

Various operations of embodiments are provided herein. The order in which some or all of the operations are described should not be construed to imply that these operations are necessarily order dependent. Alternative ordering will be appreciated having the benefit of this description. Further, it will be understood that not all operations are necessarily present in each embodiment provided herein. Also, it will be understood that not all operations are necessary in some embodiments.

It will be appreciated that layers, features, elements, etc. depicted herein are illustrated with particular dimensions relative to one another, such as structural dimensions or orientations, for example, for purposes of simplicity and ease of understanding and that actual dimensions of the same differ substantially from that illustrated herein, in some embodiments.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application and the appended claims are generally to be construed to mean "one or more" unless specified otherwise or clear from context to be directed to a singular form. Also, at least one of A and B and/or the like generally means A or B or both A and B. Furthermore, to the extent that "includes", "having", "has", "with", or variants thereof are used, such terms are intended to be inclusive in a manner similar to the term "comprising". Also, unless specified otherwise, "first," "second," or the like are not intended to imply a temporal aspect, a spatial aspect, an ordering, etc. Rather, such terms are merely used as identifiers, names, etc. for features, elements, items, etc. For example, a first element and a second element generally correspond to element A and element B or two different or two identical elements or the same element.

Also, although the disclosure has been shown and described with respect to one or more implementations, equivalent alterations and modifications will occur to others of ordinary skill in the art based upon a reading and understanding of this specification and the annexed drawings. The disclosure comprises all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. An apparatus for conditioning a semiconductor wafer polishing pad, comprising:
- a base;
- a first fiber;
- a second fiber; and
- a first polymer structure protruding from a surface of the base and encompassing the first fiber such that the first fiber protrudes from and over the first polymer structure and a bottommost surface of the first fiber is below a topmost surface of the first polymer structure, and
- a second polymer structure protruding from the surface of the base and encompassing the second fiber such that the second fiber protrudes from and over the second polymer structure and a bottommost surface of the second fiber is below a topmost surface of the second polymer structure, wherein the first polymer structure is separated from the second polymer structure.

2. The apparatus of claim 1, wherein the first fiber is a carbon fiber.

3. The apparatus of claim 1, wherein the first polymer structure encircles the first fiber.

4. The apparatus of claim 1, wherein the first fiber protrudes from the surface of the base.

5. The apparatus of claim 1, wherein:
- the first polymer structure protrudes a first distance from the surface of the base,
- the first fiber protrudes a second distance from the surface of the base, and
- the first distance is less than the second distance.

6. An apparatus for conditioning a semiconductor wafer polishing pad, comprising:
- a base; and
- a first protrusion protruding from a surface of the base, wherein:
  - a first portion of the first protrusion comprises a polymer,
  - a second portion of the first protrusion comprises carbon,
  - the first portion comprises a tip portion having a tapered sidewall, and
  - the first portion has a different material composition than the second portion.

7. The apparatus of claim 6, wherein the polymer comprises polyetheretherketone.

8. The apparatus of claim 6, wherein the first portion of the first protrusion surrounds the second portion of the first protrusion.

9. The apparatus of claim 6, wherein:
- the first portion of the first protrusion protrudes a first distance from the surface of the base,
- the second portion of the first protrusion protrudes a second distance from the surface of the base, and
- the second distance is different than the first distance.

10. The apparatus of claim 6, comprising:
- a second protrusion protruding from the surface of the base, wherein:
  - the first protrusion protrudes a first distance from the surface of the base,
  - the second protrusion protrudes a second distance from the surface of the base, and
  - the second distance is greater than the first distance.

11. An apparatus for conditioning a semiconductor wafer polishing pad, comprising:
- a base;
- a first cluster of protrusions protruding from a surface of the base at a first location on the base, wherein:
  - within the first cluster of protrusions, a first protrusion protrudes a first distance from the surface of the base and a second protrusion protrudes a second distance from the surface of the base,
  - the second distance is different than the first distance, and
  - the first protrusion and the second protrusion comprise a same composition of materials; and
- a second cluster of protrusions protruding from the surface of the base at a second location on the base, different than the first location on the base.

12. The apparatus of claim 11, wherein the first protrusion comprises a polymer encompassing a carbon fiber.

13. The apparatus of claim 12, wherein the polymer comprises polyetheretherketone.

14. The apparatus of claim 12, wherein:

the polymer protrudes a third distance from the surface of the base, the carbon fiber protrudes the first distance from the surface of the base, and the first distance is greater than the third distance.

15. The apparatus of claim 11, wherein:

the base is disk shaped such that a perimeter of the base defines a circle, the first cluster of protrusions is located a first radial distance from a center of the circle, the second cluster of protrusions is located a second radial distance from the center of the circle, and the first radial distance is greater than the second radial distance.

16. The apparatus of claim 11, comprising:

a first plurality of clusters of protrusions, including the first cluster of protrusions; and a second plurality of clusters of protrusions, including the second cluster of protrusions, wherein:

the base is disk shaped such that a perimeter of the base defines a circle, the first plurality of clusters of protrusions forms a first circle a first radial distance from the perimeter of the base, the second plurality of clusters of protrusions forms a second circle a second radial distance from the perimeter of the base, and the first radial distance is greater than the second radial distance.

17. The apparatus of claim 11, wherein:

the first protrusion comprises a first polymer encompassing a first carbon fiber, and the second protrusion comprises a second polymer encompassing a second carbon fiber.

18. The apparatus of claim 17, wherein at least one of:

a first end of the first protrusion distal from the surface of the base is not covered by the first polymer, or a second end of the second protrusion distal from the surface of the base is not covered by the second polymer.

19. The apparatus of claim 11, wherein:

the first protrusion comprises a first portion comprising a polymer and a second portion comprising carbon, and the first portion comprises a tip portion having a tapered sidewall.

20. The apparatus of claim 1, wherein the first fiber and the first polymer structure are both in contact with the base.

* * * * *